US006668149B2

(12) United States Patent
Omata et al.

(10) Patent No.: US 6,668,149 B2
(45) Date of Patent: Dec. 23, 2003

(54) IMAGE FORMING APPARATUS

(75) Inventors: Haruhiko Omata, Ibaraki (JP); Toru Katsumi, Ibaraki (JP); Shinya Suzuki, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/067,281

(22) Filed: Feb. 7, 2002

(65) Prior Publication Data

US 2002/0110392 A1 Aug. 15, 2002

(30) Foreign Application Priority Data

Feb. 13, 2001 (JP) ..... 2001/035373

(51) Int. Cl.[7] ..... G03G 15/00
(52) U.S. Cl. ..... 399/303; 399/395
(58) Field of Search ..... 399/302, 303, 399/304, 308, 313, 395

(56) References Cited

U.S. PATENT DOCUMENTS 5,017,969 A * 5/1991 Mitomi et al. ..... 399/302

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes: an image forming portion for forming an image; a transferring material conveying belt for conveying a transferring material toward the image forming portion; a driving roller for driving the transferring material conveying belt; a driven roller over which the transferring material conveying belt is looped; and a transferring portion for transferring the image formed by the image forming portion to the transferring material. The transferring material conveying belt is wound and stretched between the driven roller and the driving roller. A rotational axis of the driven roller is different from a rotational axis of the driving roller. Further, a surface of the driven roller includes a layer which has a coefficient of friction lower than a coefficient of friction of a surface of the driving roller.

12 Claims, 5 Drawing Sheets

IMAGE FORMING APPARATUS

BACKGROUND OF THE INVENTION

1. Field of the Invention

The present invention relates to an image forming apparatus, such as a copying machine, a facsimile apparatus, or a printer, which has an endless belt wound and stretched between a plurality of rollers and adapted to rotate and which forms an image on a recording material by utilizing an electrophotographic system.

2. Related Background Art

There have conventionally been proposed various image forming apparatuses, which are equipped with a plurality of image forming portions employing an electrophotographic system, and in which toner images of different colors are respectively formed on photosensitive members of the image forming portions, the toner images being successively transferred to the same recording material and superimposed one upon the other to thereby form a color image. Further, there have been proposed image forming apparatuses, such as color copying machines which are equipped with an endless transferring belt adapted to bear and convey a recording material (or an intermediate transferring belt adapted to bear and convey toner images) in order to perform high-speed color recording, a plurality of image forming portions being linearly arranged along the transferring belt.

In such image forming apparatuses, the transferring belt is wound and stretched between a driving roller and a plurality of driven rollers (rocking rollers, tension rollers, etc.), and foreign matter adhering to the surface of the transferring belt, such as toner and paper dust, is removed by a cleaning means.

In the above-described conventional image forming apparatuses, there is a fear that scattered foreign matter, such as toner and carrier, is allowed to get to the inner side of the transferring belt and adheres to the surface of the rollers between which the belt is wound and stretched. This might be prevented by providing a new cleaning means for cleaning the reverse surface of the transferring belt.

However, while in such a construction the reverse surface of the transferring belt is cleaned, there is a fear that some foreign matter, which has not been removed by the above-mentioned cleaning means, will be allowed to gradually adhere to the surface of the driven rollers. Since the foreign matter adhering to the driven rollers is not easily separated to be transferred to the reverse surface of the belt, it is difficult to remove the adhered foreign matter from the driven rollers.

When foreign matter is thus allowed to adhere to the driven roller, the transferring belt coming into contact with the portion of the driven roller where the foreign matter exists will come to have a convex portion by the foreign matter. The cleaning means (e.g., cleaning blade) for cleaning the belt surface does not abut the convex portion of the transferring belt in a satisfactory manner, resulting in a cleaning defect. And, foreign matter remaining on the belt surface (stain) as a result of such cleaning defect will adhere to a reverse surface of the coming recording material P to stain the same. Further, the convex portion will make it difficult to attain uniform contact, resulting in a transfer defect.

This problem might be solved by forming the surface portions of the rollers between which the transferring belt is wound of an elastic material, such as rubber. When the roller surface consists of rubber, if foreign matter adheres to the roller and gets in between the roller and the transferring belt, the convex portion due to the foreign matter adhering to the roller is absorbed by the elasticity of the rubber, so that the transferring belt suffers no such damage as described above.

However, when the roller surface portion is formed of rubber, the frictional force between the roller and the transferring belt will increase. And, it has been found as another problem that this change in the frictional force makes the running of the transferring belt unstable.

This will be discussed in more detail. The rocking of the transferring belt (the lateral movement of the transferring belt in a direction perpendicular to the running direction of thereof) is determined by the advancing direction of the transferring belt and the roller angle. Thus, when the plurality of rollers exhibit a great frictional force, a force is applied which causes the respective rollers to rotate the transferring belt in different directions (the axial directions of the rollers), so that the running of the transferring belt becomes unstable. For example, the transferring belt is offset until it is detached from the rollers, with the result that an end portion of the belt is damaged. It is to be noted that the larger the frictional force of the driving roller, which transmits driving force, the better. Thus, the running of the transferring belt will be more stable if exclusively the surface of the driving roller consists of rubber.

In addition, when in such an apparatus toner adheres to the driven rollers to cause a change in frictional force, there is also a fear that the rocking control of the belt will become unstable.

SUMMARY OF THE INVENTION

The present invention has been made in view of the above problems. It is an object of the present invention to prevent generation of a local convex portion as a result of adhesion of foreign matter, such as scattered toner, to the rollers between which the transferring material carrying belt or the intermediate transferring belt is wound and stretched, thereby preventing staining of the rear surface of the transfer material due to cleaning defect of the belt, transfer defect, etc.

In order to achieve the above-mentioned object, according to a preferred embodiment of the present invention, there is provided an image forming apparatus including: an image forming means for forming an image; a transferring material conveying belt for conveying a transferring material toward the image forming means; a driving roller for driving the transferring material conveying belt; a driven roller around which the transferring material conveying belt is wound; and a transferring means for transferring the image formed by the image forming means to the transferring material, in which the surface of the driven roller has a layer whose coefficient of friction is lower than that of the surface of the driving roller.

According to another preferred embodiment of the present invention, there is provided an image forming apparatus including: an image forming means for forming an image; an intermediate transferring belt to which the image formed by the image forming means is transferred; a driving roller for driving the intermediate transferring belt; a driven roller around which the intermediate transferring belt is wound; and a transferring means for transferring the image on the intermediate transferring belt to a transferring material, in which the surface of the driven roller has a layer whose coefficient of friction is lower than that of the surface of the driving roller.

DESCRIPTION OF THE PREFERRED EMBODIMENTS

Preferred embodiments of the present invention will now be described in detail with reference to the drawings. It is to be noted that the dimensions, materials, configurations, and relative arrangement of the components as given in the following embodiments are to be appropriately changed according to the construction of the apparatus to which the present invention is applied and various conditions, and should not be construed restrictively.

First Embodiment

Figure 1:
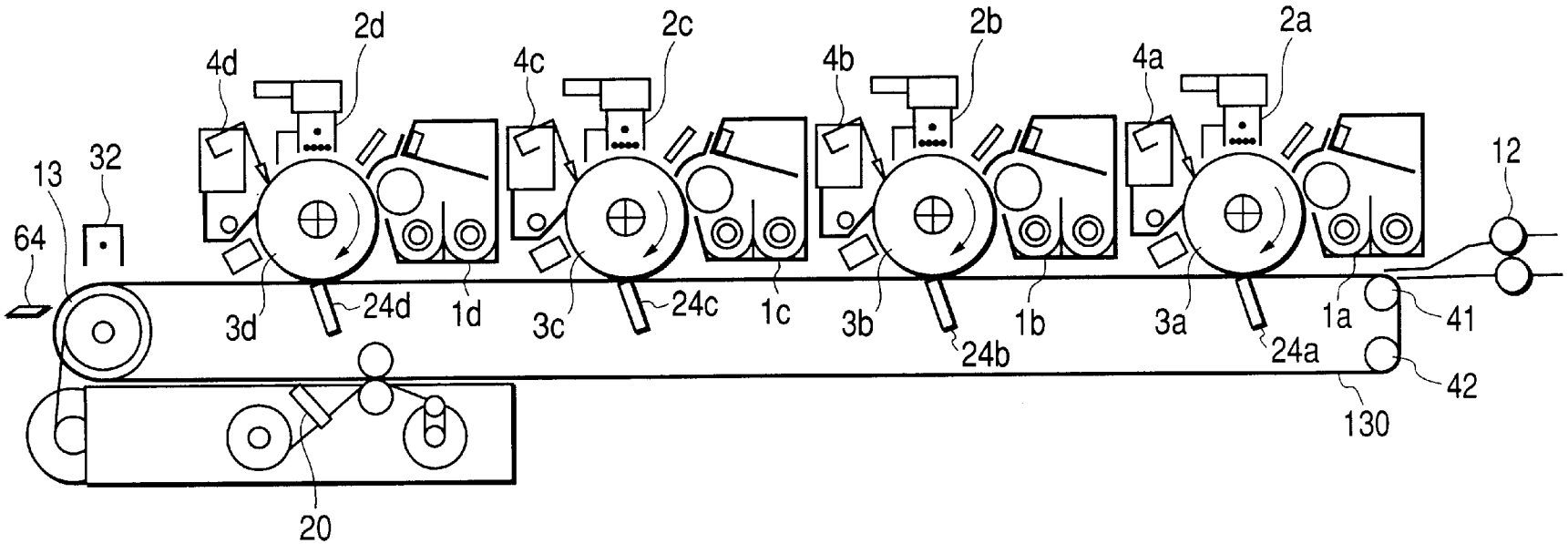
FIG. 1 is a structural diagram mainly showing image forming portions and the periphery thereof according to a first embodiment of the present invention.

The first embodiment of the present invention will be described in detail with reference to the drawings. FIG. 1 is a structural diagram mainly showing image forming portions equipped with a belt conveying device and the periphery thereof according to this embodiment, and FIG. 4 is a schematic structural diagram showing an image forming apparatus equipped with a belt conveying device according to this embodiment.

First, the schematic construction of the image forming apparatus will be briefly described with reference to FIG. 4, and then the belt conveying device of the present invention will be described in detail.

(Construction of the Image Forming Apparatus)

Figure 4:
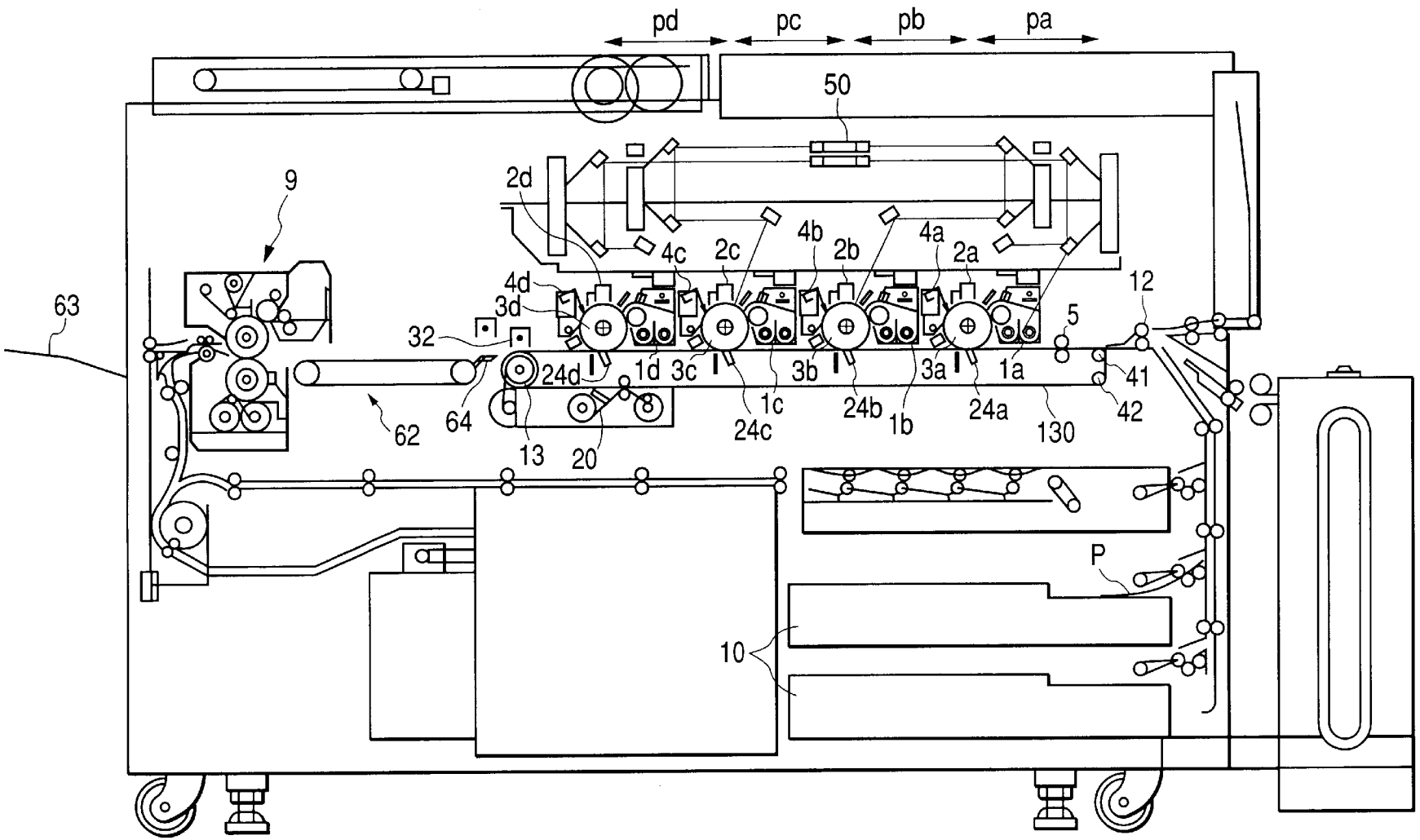
FIG. 4 is a schematic structural diagram showing an image forming apparatus according to the first embodiment of the present invention.

As shown in FIGS. 1 and 4, arranged in the apparatus are four image forming portions (magenta, cyan, yellow, and black), each consisting of an image forming means formed by arranging a developing device, etc. around an electrophotographic photosensitive member (hereinafter referred to as the "photosensitive drum") which serves as an image bearing member. An image on the photosensitive drum formed by a predetermined process in each image forming portion is transferred to a recording material, such as paper (hereinafter referred to as transfer paper) on an endless belt constituting a belt conveying device running adjacent to the photosensitive drum.

More specifically, there is provided above each of the image forming portions Pa, Pb, Pc, and Pd a reader portion for reading the original by a photoelectric conversion device, such as a CCD. Further, photosensitive drums 3*a*, 3*b*, 3*c*, and 3*d* for forming magenta, cyan, yellow, and black images are respectively arranged in the image forming portions Pa, Pb, Pc, and Pd, the photosensitive drums 3*a*, 3*b*, 3*c*, and 3*d* being rotatable in the direction of the arrows. Further, respectively arranged around the photosensitive drums 3*a*, 3*b*, 3*c*, and 3*d* are electrifiers 2*a*, 2*b*, 2*c*, and 2*d*, a laser scanning portion 50, developing devices 1*a*, 1*b*, 1*c*, and 1*d*, and cleaners 4*a*, 4*b*, 4*c*, and 4*d* in that order in the direction in which the photosensitive drums rotate. Arranged below the photosensitive drums 3*a*, 3*b*, 3*c*, and 3*d* is a transferring belt (endless belt) 130, which is a transferring material conveying belt constituting the belt conveying device. And, transfer chargers 24*a*, 24*b*, 24*c*, and 24*d* are respectively opposed to the photosensitive drums 3*a*, 3*b*, 3*c*, and 3*d*, with the transferring belt 130 therebetween.

The transferring belt 130 is wound and stretched between a driving roller 13 and driven rollers: a rocking roller 41 and a tension roller 42. Further, there is provided a cleaning means 20 for removing toner adhering to the surface of the transferring belt 130. And, after the separation of the recording material, toner, paper dust, etc. adhering to the surface of the transferring belt 130 is removed by the cleaning means 20, and residual charge is removed by a transferring belt charge removing portion.

In the above-described apparatus, a recording material P supplied from sheet feeding cassettes 10 constituting the recording material supplying means through registration rollers 12 is successively conveyed to the image forming portions Pa, Pb, Pc, and Pd while being supported by the transferring belt 130, and toner images of different colors formed on the photosensitive drums 3*a*, 3*b*, 3*c*, and 3*d* are successively transferred to the recording material. After the completion of this transfer process, charge is removed from the recording material P by a separation electrifier 32, and the electrostatic attraction force is attenuated, whereby the recording material is separated from the transferring belt 130. The recording material thus separated is supported by a guide member 64, and is conveyed to a fixing apparatus 9 by a conveying belt 62, and the toner images are fixed by the fixing apparatus 9 through heating and pressurization before discharging the recording material to the exterior of the apparatus (sheet discharging tray 63).

(Construction of the Belt Conveying Device)

Next, rocking control of the transferring belt 130 constituting the belt conveying device will be described. There are two methods of control of the transferring belt 130 in a direction perpendicular to its running direction, i.e., rocking control: a method in which a rib is attached to an end portion of the transferring belt to control offset, and an active control method in which the position of the transferring belt is detected and, on the basis of the detection result, the angle of one of the rollers between which the transferring belt is stretched is controlled to correct the offset of the transferring belt, restoring it actively to the original position.

Figure 2A:
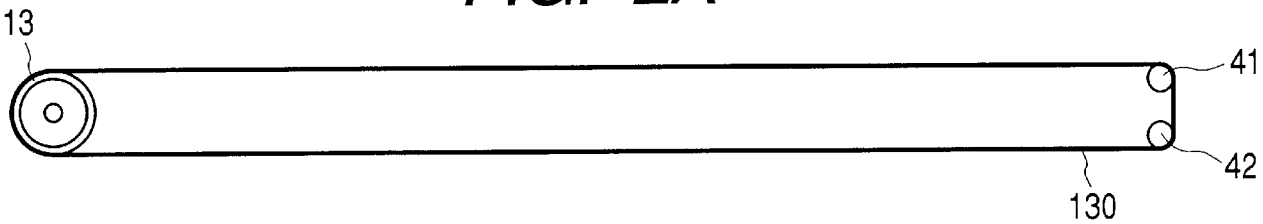
FIGS. 2A and 2B are diagrams illustrating belt rocking control.
Figure 2B:
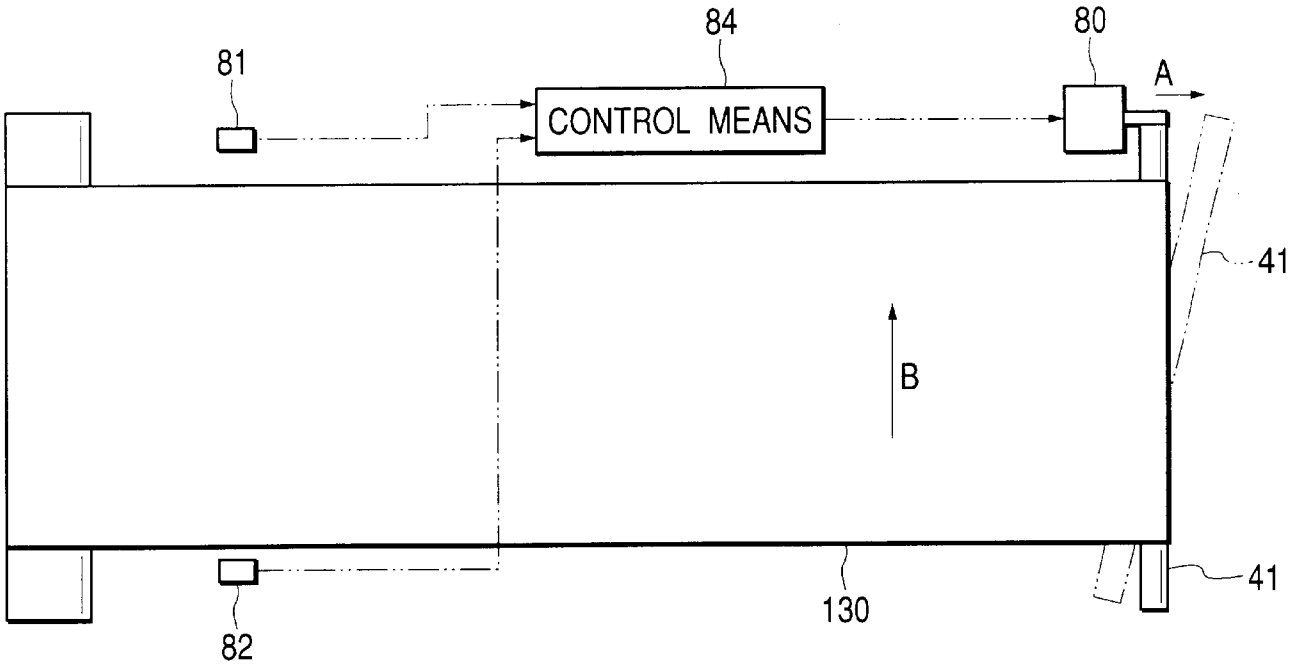

Here, the above-mentioned active control method will be described with reference to FIGS. 2A and 2B. FIG. 2A is a side view of the transferring belt, and FIG. 2B is a plan view of the transferring belt. In the active control, end portions of the transferring belt 130 (end portions with respect to the width direction, which is perpendicular to the recording material conveying direction) are detected by transferring belt end potion detection sensors 81 and 82, and, on the basis of the detection result, a control means 84 controls a rocking motor 80 to vary the angle of the rocking roller 41. For example, when the transferring belt end portion detection sensor 82 detects a belt end portion, the rocking motor 80 moves the rocking roller 41 in the direction of the arrow A. Then, the transferring belt 130 moves in the direction of the arrow B. By repeating this operation, it is possible to rotate the transferring belt 130 in a stable manner.

The surfaces of the rocking roller 41 and the tension roller 42, which are caused to rotate by the endless transferring belt 130, are coated with fluororesin. In this embodiment, the thickness of the fluororesin coating is approximately 300 $\mu$m, which, however, should not be construed restrictively. Examples of the fluororesin that can be employed include PFA, PTFE, and PVdF. It is also possible to cover the driven roller with a fluororesin tube.

Further, the material of the driven roller surface portion may be a material other than fluororesin coating as long as its coefficient of friction is smaller than that of the surface of the driving roller and it is capable of preventing toner adhesion. For example, it may also be a layer of a resin material to which fluorine is added. Apart from fluorine, it may also be coating of a silicone resin or a layer of a resin containing silicone. It is also possible to adopt a resin containing silicone oil.

The transferring belt 130 consists of a sheet of a dielectric resin, such as polyimide, polyethylene terephthalate, polyvinylidene fluoride, or polyurethane. It is possible to use a sheet material whose end portions are superimposed one upon the other and joined together to form an endless configuration, or a seamless belt having no joint.

Figure 3:
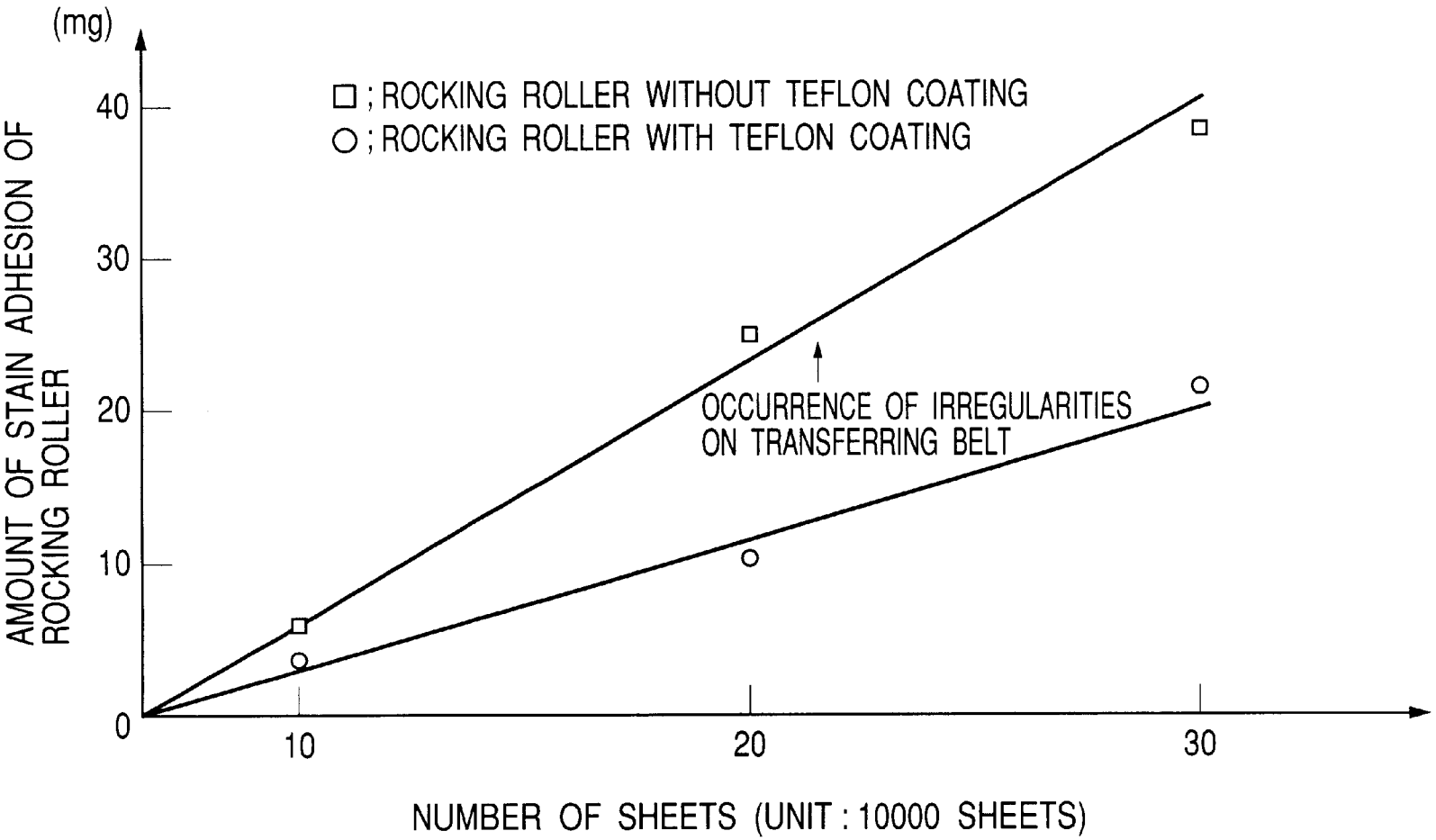
FIG. 3 is a diagram showing the effect of the present invention.

The image forming apparatus as described above was subjected to an endurance test. The test was conducted in a high-temperature, high-humidity environment, in which foreign matter, such as toner, is liable to adhere to the transferring belt, using an A4 size recording material of basis weight 80 g/m$^2$ and repeating the operation of copying a single sheet. The test result is shown in FIG. 3.

In a conventional image forming apparatus, using a metal roller with no fluororesin coating as the driven roller (rocking roller) rotated by the transferring belt, irregularities (i.e., convex and concave portions) occurred in the transferring belt when the number of sheets exceeded approximately 200,000, recording-material back side staining due to a cleaning defect of the transferring belt being generated. Further, any transfer defect due to the irregularities of the transfer belt was to be observed.

In contrast, in the apparatus of the present invention, in which, as described above, the rocking roller 41 and tension roller 42 coated with fluororesin are used as the driven rollers caused to rotate by the transferring belt, no irregularities were generated in the transferring belt even when the number of sheets exceeded 300,000. Further, the above-mentioned fluororesin coating (e.g., Teflon coating) was not worn to allow the roller surface (e.g., the metal surface) to be exposed.

In another experiment, stain adhered to the tension roller (driven roller caused to rotate by the transferring belt) as a result of the endurance test, and the active rocking control became unstable, the transferring belt being offset to the utmost to cause damage to an end portion of the transferring belt.

In the image forming apparatus of the present invention, in contrast, which uses the above-mentioned fluororesin coated rocking roller 41 and tension roller 42 as the driven roller caused to rotate by the transferring belt, the active rocking control did not become unstable.

While in this embodiment the present invention is applied to the driven rollers over which the endless belt (transferring belt) conveying the recording material is looped in an image forming apparatus capable of color image formation, this should not be construed restrictively. It goes without saying that the same effect can be obtained with a monochrome image forming apparatus using a transferring belt consisting of an endless belt.

As described above, in accordance with this embodiment, the surfaces of the rocking roller 41 and the tension roller 42 around which the transferring belt 130 is wound are coated with fluororesin, whereby foreign matter does not easily adhere to the surface of the rollers, thereby preventing local generation of a swollen portion in the transferring belt 130 and preventing staining of the back surface of the recording material P, transfer defect, due to cleaning defect of the transferring belt 130 etc.

Second Embodiment

Figure 5:
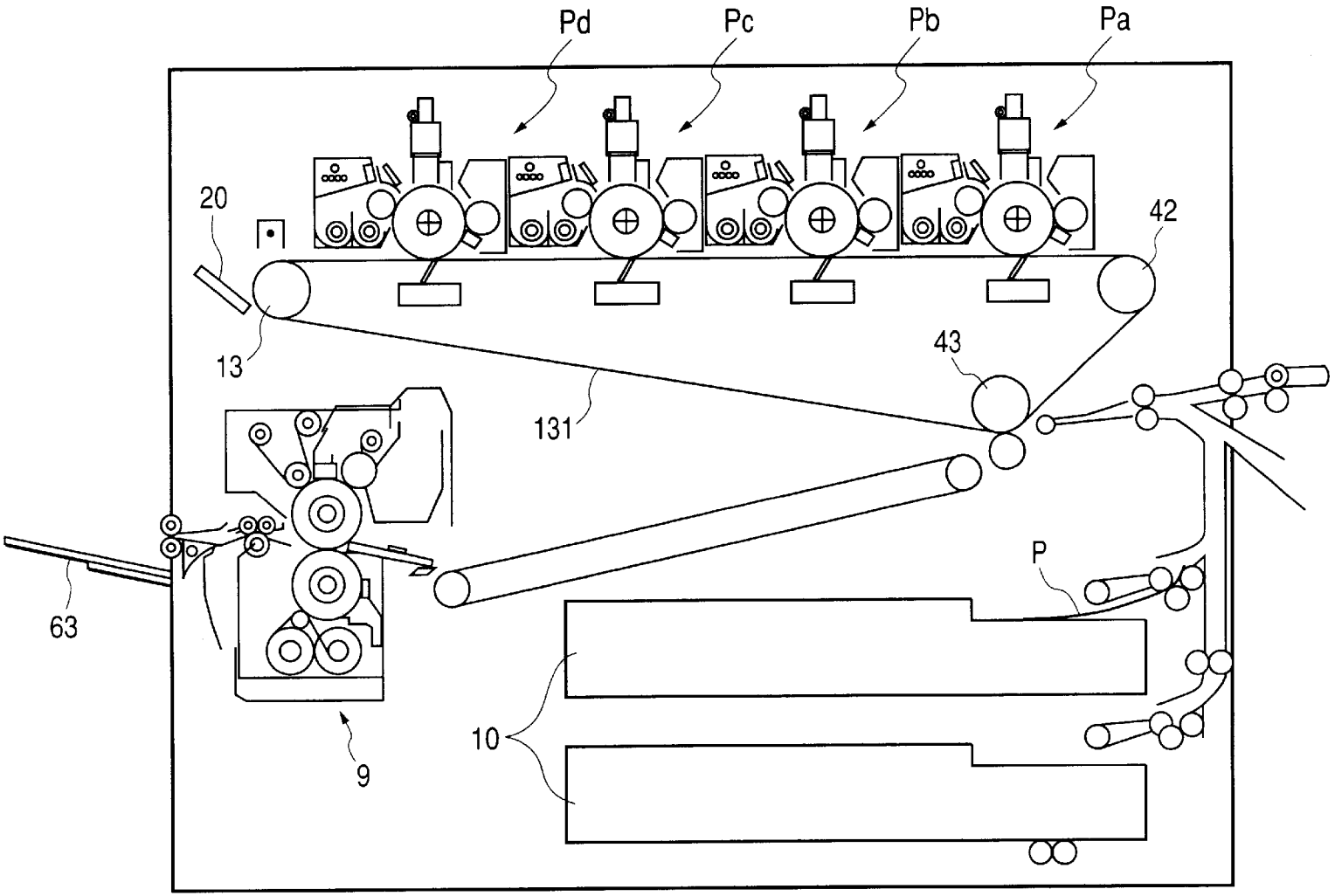
FIG. 5 is a schematic structural diagram showing an image forming apparatus according to a second embodiment of the present invention.

Next, another embodiment of the present invention will be described in detail with reference to FIG. 5. FIG. 5 is a schematic diagram showing the construction of an image forming apparatus equipped with a belt conveying device according to this embodiment.

In this embodiment, the present invention is applied to an intermediate transferring belt of a so-called intermediate transfer type image forming apparatus, in which toner images on the photosensitive drums are transferred to an intermediate transferring belt consisting of an endless belt and superimposed one upon the other to be collectively transferred to the recording material.

As shown in FIG. 5, an intermediate transferring belt 131 consisting of an endless belt is stretched between a driving roller 13, a tension roller 42, and a secondary transferring roller 43. In this embodiment, the material of the intermediate transferring belt 131 is a polyimide whose volume resistivity is $1\times10^{12}$ Ω cm.

Toner images formed in the image forming portions Pd, Pc, Pb, and Pa successively undergo primary transfer to be superimposed one upon the other on the intermediate transferring belt 131, and are then collectively transferred to the transferring material P conveyed from the cassette 10 by the secondary transferring roller 43. Thereafter, they are fixed by the fixing means 9.

For the rocking control of the intermediate transferring belt 131, the rib control system described with reference to the above embodiment is used. That is, rubber ribs are glued to the inner sides of the ends (the ends with respect to the width direction perpendicular to the recording material conveying direction), and these ribs abut the end portion of the driving roller 13, whereby the belt is prevented from being offset to the end. As compared with the active control of the above-described embodiment, this rib control system is advantageous in that it is of a simple construction. On the other hand, it has a problem in that the ribs are subject to separation and that belt breakage will occur from the rib joint portions. Thus, in this image forming apparatus also, the rocking control for the intermediate transferring belt may be conducted by the active control method.

An endurance test was conducted on this image forming apparatus. When the tension roller 42 and the secondary transferring roller 43 over which the intermediate transferring belt 131 is looped were formed as metal rollers, foreign matter, such as toner, adhered to these rollers when the number of sheets attained approximately 20,000, and irregularities were generated on the intermediate transferring belt 131, staining due to cleaning defect, transfer defect, etc. occurring.

In contrast, when the endurance test was conducted with fluororesin coating (Teflon coating) being effected on the tension roller 42 and the secondary transfer roller 43 over which the intermediate transfer belt 131 is looped, no irregularities were generated on the intermediate transferring belt 131 even when the number of sheets exceeded 50,000.

As described above, in this embodiment also, by coating with fluororesin the surfaces of the tension roller 42 and the secondary transferring roller 43 over which the intermediate transferring belt 131 is looped, foreign matter does not easily adhere to the roller surfaces, so that it is possible to prevent local generation of a swollen portion in the intermediate transferring belt 131, whereby it is possible to prevent staining of the recording material P due to a cleaning defect of the intermediate transferring belt 131.

In this embodiment also, there is no particular restriction regarding the material of the surface layer of the driven rollers, such as the tension roller 42 and the secondary transferring roller 43. It is also possible to employ a material other than the above-mentioned fluororesin coating as long as it is a material whose coefficient of friction is smaller than that of the surface of the driving roller and which is capable of preventing toner adhesion. For example, it is also possible to form a layer of a resin material to which fluorine is added. Further, apart from the fluorine material, it is also possible to provide a coating or a layer of a resin containing silicone resin or the like. Further, it is also possible to form a layer of a resin containing silicone oil.

What is claimed is:

1. An image forming apparatus comprising:

an image forming means for forming an image;

a transferring material conveying belt for conveying a transferring material toward said image forming means;

a driving roller for driving said transferring material conveying belt;

a driven roller, wherein said transferring material conveying belt is wound and stretched between said driver roller and said driving roller, wherein a rotational axis of said driven roller is different from a rotational axis of said driving roller, and wherein a surface of said driven roller includes a layer, which has a coefficient of friction lower than a coefficient of friction of a surface of said driving roller; and a transferring means for transferring the image formed by said image forming means to the transferring material.

2. An image forming apparatus according to claim 1, wherein said layer includes a fluororesin.

3. An image forming apparatus according to claim 1, wherein said layer is formed by fluororesin coating.

4. An image forming apparatus according to claim 1, further comprising a cleaning means for cleaning the surface of said transferring material conveying belt.

5. An image forming apparatus according to claim 1, further comprising an offset control means for performing offset control of said transferring material conveying belt.

6. An image forming apparatus according to claim 5, wherein said offset control means performs offset control by changing a position of said driven roller.

7. An image forming apparatus comprising:

an image forming means for forming an image;

an intermediate transferring belt to which the image formed by said image forming means is transferred;

a driving roller for driving said intermediate transferring belt;

a driven roller around which said intermediate transferring belt is wound, wherein said transferring material conveying belt is wound and stretched between said driver roller and said driving roller, wherein a rotational axis of said driven roller is different from a rotational axis of said driving roller, and wherein a surface of said driven roller includes a layer, which has a coefficient of friction lower than a coefficient of friction of a surface of said driving roller; and a transferring means for transferring the image on said intermediate transferring belt to a transferring material.

8. An image forming apparatus according to claim 7, wherein said layer includes a fluororesin.

9. An image forming apparatus according to claim 7, wherein said layer is formed by fluororesin coating.

10. An image forming apparatus according to claim 7, further comprising a cleaning means for cleaning the surface of said intermediate transferring belt.

11. An image forming apparatus according to claim 7, further comprising an offset control means for performing offset control of said intermediate transferring belt.

12. An image forming apparatus according to claim 11, wherein said offset control means performs offset control by changing a position of said driven roller.

* * * * *